US010865785B2

(12) United States Patent
Mou et al.

(10) Patent No.: US 10,865,785 B2
(45) Date of Patent: Dec. 15, 2020

(54) GAS TRANSPORTATION DEVICE

(71) Applicant: Microjet Technology Co., Ltd., Hsinchu (TW)

(72) Inventors: Hao-Jan Mou, Hsinchu (TW); Shih-Chang Chen, Hsinchu (TW); Jia-Yu Liao, Hsinchu (TW); Hung-Hsin Liao, Hsinchu (TW); Chi-Feng Huang, Hsinchu (TW); Chang-Yen Tsai, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 75 days.

(21) Appl. No.: 16/124,487

(22) Filed: Sep. 7, 2018

(65) Prior Publication Data

US 2019/0128251 A1 May 2, 2019

(30) Foreign Application Priority Data

Oct. 27, 2017 (TW) ..... 106137192 A

(51) Int. Cl.
*F04B 45/047* (2006.01)
*F04B 45/04* (2006.01)
*F04B 43/04* (2006.01)

(52) U.S. Cl.
CPC ..... *F04B 45/047* (2013.01); *F04B 43/046* (2013.01); *F04B 45/043* (2013.01)

(58) Field of Classification Search
CPC ..... F04B 41/06; F04B 43/00; F04B 43/0009; F04B 43/0018; F04B 43/0027;
(Continued)

(56) References Cited

U.S. PATENT DOCUMENTS

2016/0201665 A1* 7/2016 Hirata ..... F04B 41/06 417/278
2016/0377073 A1* 12/2016 Tanaka ..... F04B 53/16 417/413.2

(Continued)

FOREIGN PATENT DOCUMENTS

CN 205478231 U 8/2016
CN 206477983 U 9/2017

*Primary Examiner* — Patrick Hamo
*Assistant Examiner* — Chirag Jariwala
(74) *Attorney, Agent, or Firm* — Birch, Stewart, Kolasch & Birch LLP

(57) ABSTRACT

A gas transportation device includes a gas outlet cover, plural flow-guiding pedestals and plural gas pumps. The gas outlet cover includes a gas outlet nozzle and a gas outlet cavity. The gas outlet nozzle and the gas outlet cavity are in communication with each other. Each flow-guiding pedestal includes a main plate, a protruding frame and a chamber frame. The main plate includes a recess and a communicating aperture in communication with the recess. The gas pumps are disposed inside the chamber frames of the flow-guiding pedestals, respectively. The gas outlet cover covers the flow-guiding pedestals and is connected to the protruding frames, whereby plural convergence chambers are defined and are in communication with the gas outlet cavity. Consequently, the gas is transported through the recesses, the communicating apertures, the convergence chambers and the gas outlet cavity sequentially, and finally is discharged out from the gas outlet nozzle.

6 Claims, 11 Drawing Sheets

(58) Field of Classification Search
CPC .. F04B 43/0054; F04B 43/025; F04B 43/026; F04B 43/046; F04B 45/04; F04B 45/043; F04B 45/045; F04B 45/10
USPC ..... 417/413.2
See application file for complete search history.

(56) References Cited

U.S. PATENT DOCUMENTS

| | | | | |
|---|---|---|---|---|
| 2018/0066650 | A1* | 3/2018 | Fujisaki | F02B 43/02 |
| 2018/0223829 | A1* | 8/2018 | Tanaka | F04B 35/045 |
| 2018/0335029 | A1* | 11/2018 | Fujisaki | F04B 39/12 |

* cited by examiner

GAS TRANSPORTATION DEVICE

FIELD OF THE INVENTION

The present disclosure relates to a gas transportation device, and more particularly to a gas transportation device with increased gas transporting capacity.

BACKGROUND OF THE INVENTION

Nowadays, in various fields such as pharmaceutical industries, computer techniques, printing industries or energy industries, the products are developed toward elaboration and miniaturization. The gas transportation devices are important components that are used in micro pumps. Therefore, how to utilize an innovative structure to break through the bottleneck of the prior art has become an important part of development.

With the rapid development of science and technology, the applications of gas transportation devices are becoming more and more diversified. For example, gas transportation devices are gradually popular in industrial applications, biomedical applications, medical care applications, electronic cooling applications and so on, or even the wearable devices. It is obvious that the gas transportation devices gradually tend to miniaturize the structure and maximize the flow rate thereof.

In accordance with the existing technologies, the gas transportation device is assembled by stacking plural conventional mechanical parts. For achieving the miniature and slim benefits of the overall device, all mechanical parts are minimized or thinned. However, since the individual mechanical part is minimized, it is difficult to the control the size precision and the assembling precision. Consequently, the product yield is low and inconsistent, or even the flowrate of the gas is not stable.

Moreover, the amount of the gas transported by the conventional gas transportation device is insufficient. Therefore, the requirement of transporting great amount of the gas cannot be satisfied by single gas transportation device. Therefore, there is a need of providing a gas transportation device with increased gas transporting capacity.

SUMMARY OF THE INVENTION

An object of the present disclosure provides a gas transportation device. The miniature gas pumps of the gas transportation device are arranged side by side, so as to achieve the efficacy of high gas transporting efficiency.

In accordance with an aspect of the present disclosure, a gas transportation device is provided. The gas transportation device includes a gas outlet cover, plural flow-guiding pedestals and plural gas pumps. The gas outlet cover includes a gas outlet nozzle and a gas outlet cavity. The gas outlet nozzle and the gas outlet cavity are in communication with and spatially corresponding to each other. Each of the flow-guiding pedestals includes a main plate, a protruding frame and a chamber frame. The main plate has a recess and a communicating aperture in communication with the recess. The gas pumps are disposed in the chamber frames of the flow-guiding pedestals, respectively. The flow-guiding pedestals are arranged side by side. The gas outlet cover covers and seals the flow-guiding pedestals and is closely connected to the protruding frames of the flow-guiding pedestals, whereby plural convergence chambers are defined and are in communication with the gas outlet cavity. While the gas pumps are enabled to transport gas, the gas is transported through the recesses, the communicating apertures, the convergence chambers and the gas outlet cavity, and finally is discharged out from the gas outlet nozzle.

The above contents of the present disclosure will become more readily apparent to those ordinarily skilled in the art after reviewing the following detailed description and accompanying drawings, in which:

DETAILED DESCRIPTION OF THE PREFERRED EMBODIMENT

Figure 1A:
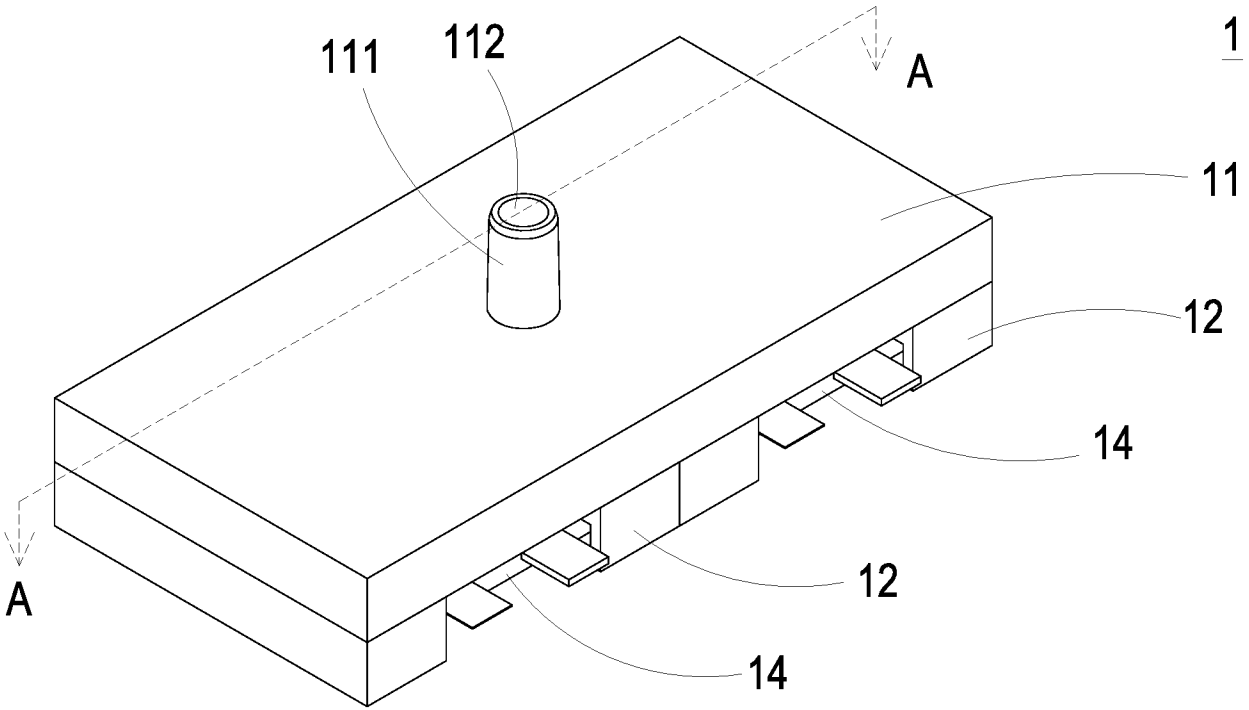
FIG. 1A is a schematic perspective view illustrating the gas transportation device according to an embodiment of the present disclosure.

The present disclosure will now be described more specifically with reference to the following embodiments. It is to be noted that the following descriptions of preferred embodiments of this disclosure are presented herein for purpose of illustration and description only. It is not intended to be exhaustive or to be limited to the precise form disclosed.

Please refer to FIGS. 1A to 3B. The present discourse provides a gas transportation device including at least one gas outlet cover 11, at least one gas outlet nozzle 111, at least one gas outlet cavity 114, plural flow-guiding pedestals 12, at least one main plate 120, at least one protruding frame 121, at least one chamber frame 122, at least one recess 124, at least one communicating aperture 125, plural gas pumps 14 and at least one convergence chamber 123. The number of the gas outlet cover 11, the gas outlet nozzle 111, the gas outlet cavity 114, the main plate 120, the protruding frame 121, the chamber frame 122, the recess 124, the communicating aperture 125 and the convergence chamber 123 is exemplified by one for each in the following embodiments but not limited thereto. It is noted that each of the gas outlet cover 11, the gas outlet nozzle 111, the gas outlet cavity 114, the main plate 120, the protruding frame 121, the chamber frame 122, the recess 124, the communicating aperture 125 and the convergence chamber 123 can also be provided in plural numbers.

The gas transportation device of the present disclosure is applicable to various electronic devices and medical apparatuses for increasing the amount of the gas to be transported. Please refer to FIGS. 1A and 1B. The gas transportation device 1 includes a gas outlet cover 11, plural flow-guiding pedestals 12 and plural gas pumps 14. Each gas pump 14 is accommodated in the corresponding one of the flow-guiding pedestals 12. The flow-guiding pedestals 12 are arranged side by side in horizontal direction. The gas outlet cover 11 covers and seals the flow-guiding pedestals 12. The gas pumps 14 are used for transporting the gas. While the gas pumps 14 are enabled to transport the gas simultaneously, the gas is transported and converged through the gas outlet cover 11 and the flow-guiding pedestals 12, and is rapidly discharged out from a gas outlet nozzle 111 of the gas outlet cover 11. Consequently, the efficacy of increasing the amount of the gas to be transported is achieved. For describing the technical content of the present disclosure, for example but not exclusively, both of the numbers of the flow-guiding pedestals 12 and the gas pumps 14 are two, and accordingly, the detailed structures and the actions of the gas transportation device 1 are further described in the following paragraphs.

In this embodiment, the numbers of the flow-guiding pedestals 12 and the gas pumps 14 are corresponding to each other. That is, if the number of the gas pumps 14 is three, the number of the flow-guiding pedestals 12 is also three. The numbers of the flow-guiding pedestals 12 and the gas pumps 14 are not limited and may be varied according to the practical requirements. Additionally, the size of the gas outlet cover 11 can be varied according to the number of the flow-guiding pedestals 12, by which the gas outlet cover 11 can cover and seal the top of the flow-guiding pedestals 12 for allowing the gas to be transported and converged.

Figure 2A:
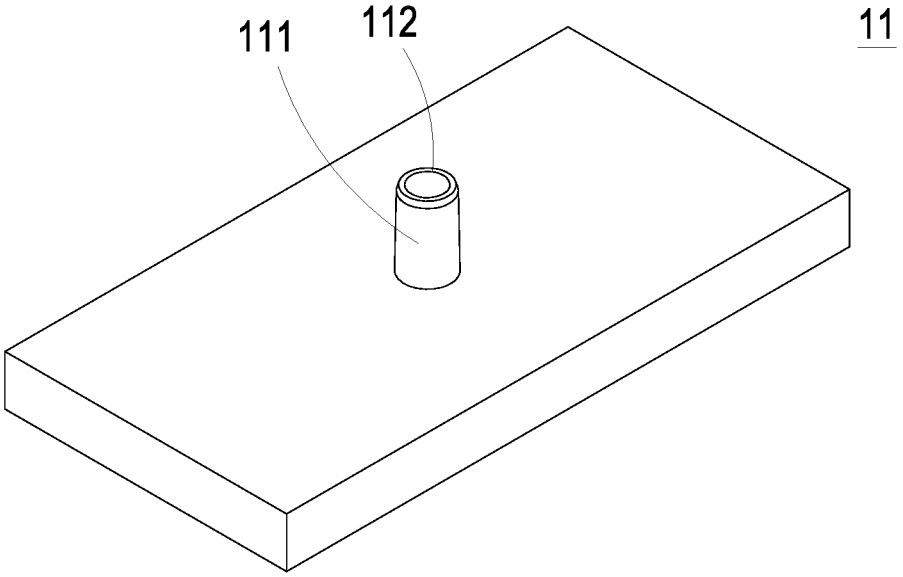
FIG. 2A is a schematic perspective view illustrating the gas outlet cover of FIG. 1B and taken along a front side.
Figure 2B:
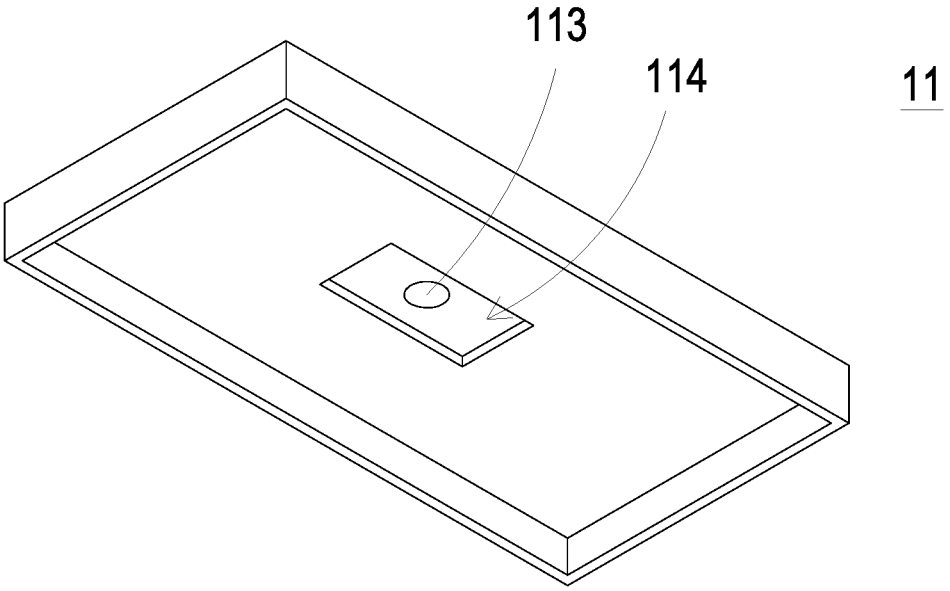
FIG. 2B is a schematic perspective view illustrating the gas outlet cover of FIG. 2A and taken along the rear side.

Please refer to FIGS. 2A and 2B. In this embodiment, the gas outlet cover 11 includes the gas outlet nozzle 111 and a gas outlet cavity 114. The gas outlet nozzle 111 and the gas outlet cavity 114 are in communication with and spatially corresponding to each other. The gas outlet nozzle 111 has a discharging opening 112, and the gas outlet cavity 114 has an inlet opening 113. The discharging opening 112 is disposed in the gas outlet nozzle 111 and is in communication with the inlet opening 113 of the gas outlet cavity 114. A diameter of the inlet opening 113 of the gas outlet cavity 114 is larger than a diameter of the discharging opening 112 of the gas outlet nozzle 111. More specifically, the gas outlet nozzle 111 is designed in a conical shape that the gas outlet nozzle 111 is gradually tapered from the inlet opening 113 to the discharging opening 112, but not limited thereto. Accordingly, the gas outlet nozzle 111 has interior diameters which are gradually decreased from the inlet opening 113 to the discharging opening 112. Owing to the conical shape of the gas outlet nozzle 111, the gas can be effectively converged and then be rapidly transported by the gas outlet nozzle 111.

Figure 3A:
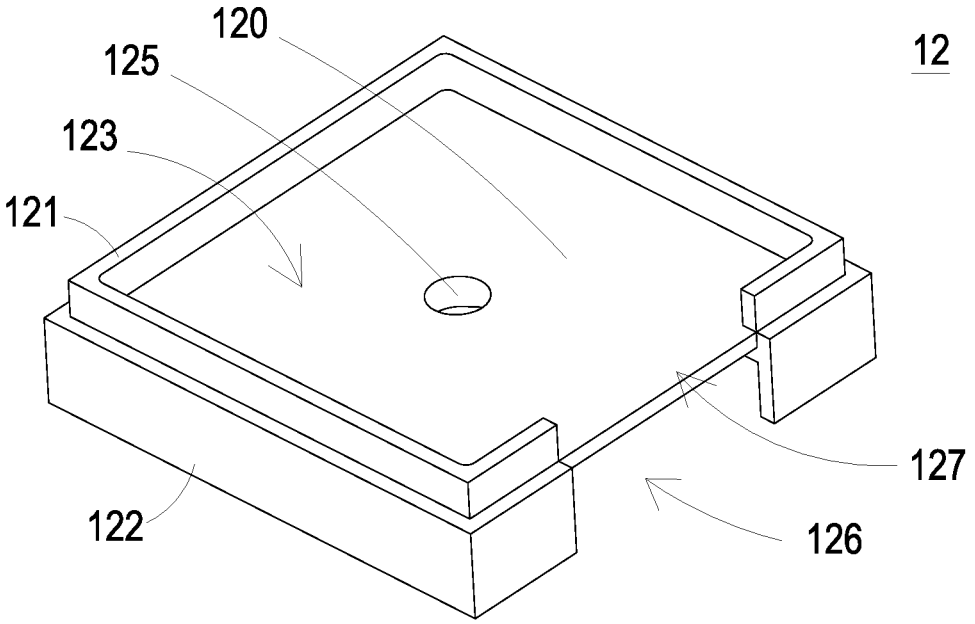
FIG. 3A is a schematic perspective view illustrating the flow-guiding pedestal of FIG. 1B and taken along a front side.
Figure 3B:
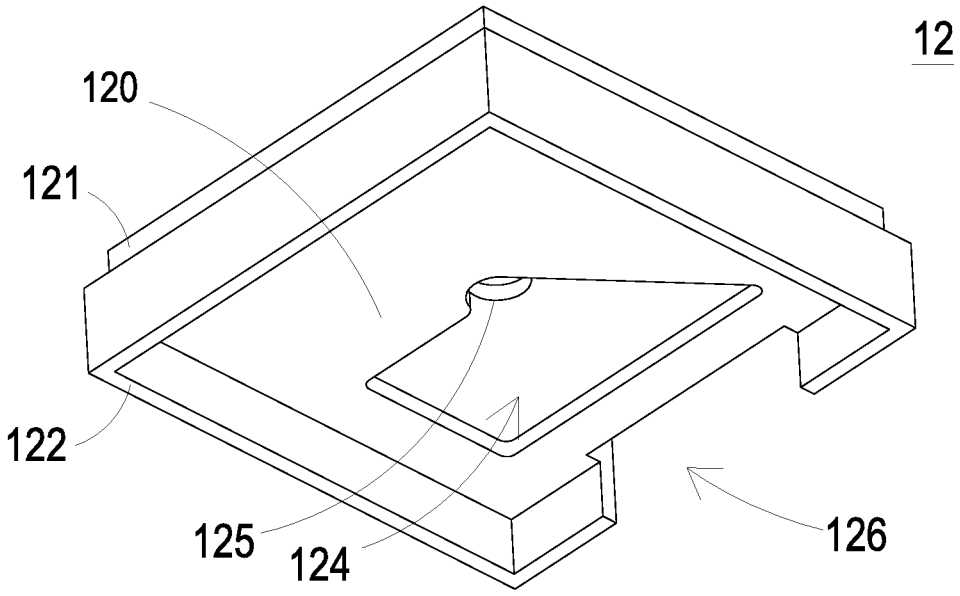
FIG. 3B is a schematic perspective view illustrating the flow-guiding pedestal of FIG. 3A and taken along a rear side.

Please refer to FIGS. 3A and 3B. The flow-guiding pedestals 12 have same structure with each other. For avoiding redundant description, only the structure of one of the flow-guiding pedestals 12 is described in the following descriptions. The flow-guiding pedestal 12 includes a main plate 120, a protruding frame 121 and a chamber frame 122. The main plate 120 includes a recess 124 and a communicating aperture 125 in communication with the recess 124. The protruding frame 121 protrudes above and is arranged around a periphery of the main plate 120. The chamber frame 122 protrudes below and is arranged around the periphery of the main plate 120. In addition, a side length of the protruding frame 121 is smaller than a side length of the chamber frame 122, so that a profile of the protruding frame 121 on the main plate 120 would not match a profile of the chamber frame 122 on the main plate 120, and a stepped structure is formed around the periphery of the main plate 120, by which the gas outlet cover 11 can be engaged with the stepped structure and disposed on the flow-guiding pedestal 12. Moreover, the protruding frame 121 has an adhesive-injecting opening 127, and the chamber frame 122 has a pin opening 126.

Figure 5A:
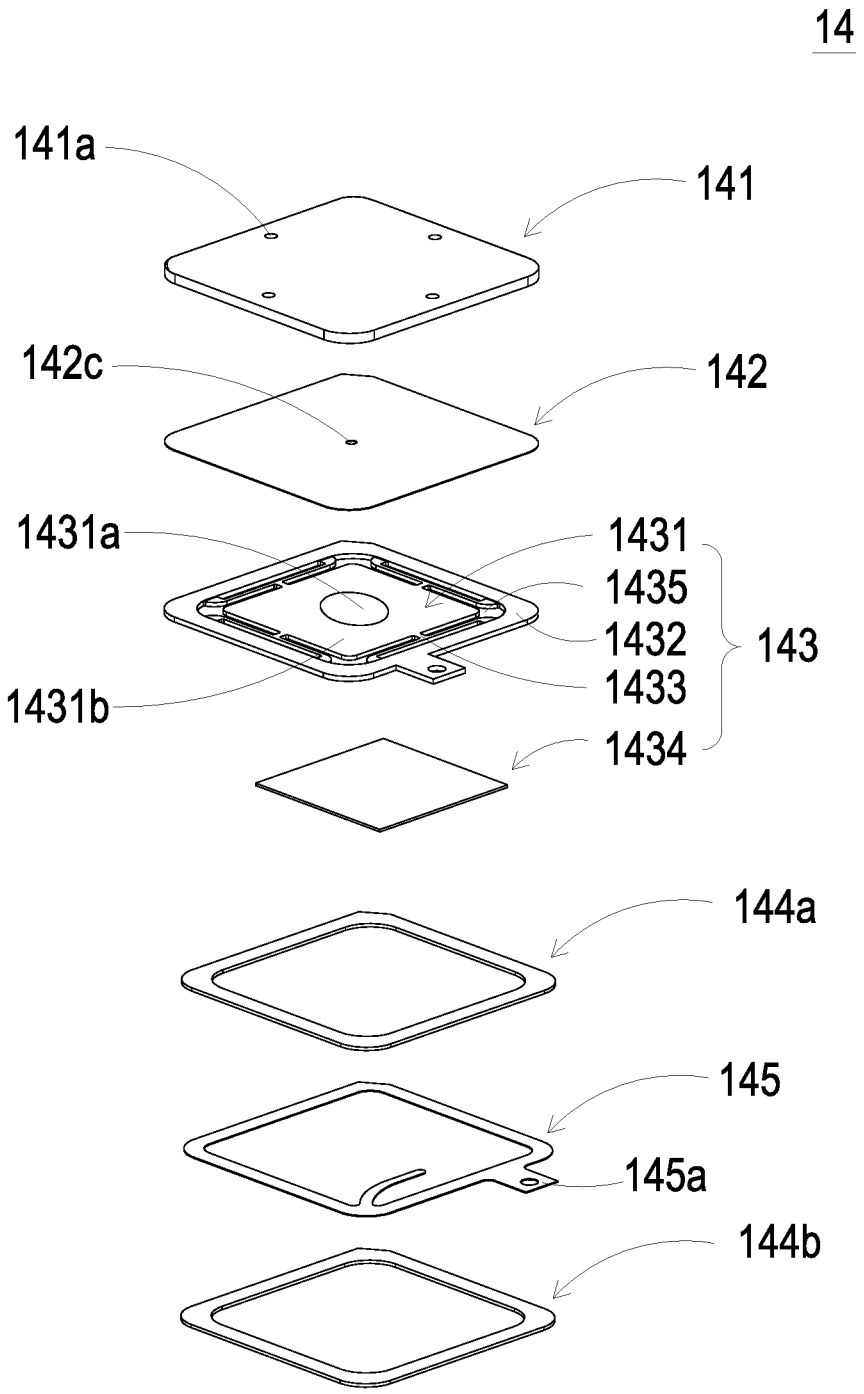
FIG. 5A is a schematic exploded view illustrating the gas pump according to the embodiment of the present disclosure and taken along a front side.
Figure 5B:
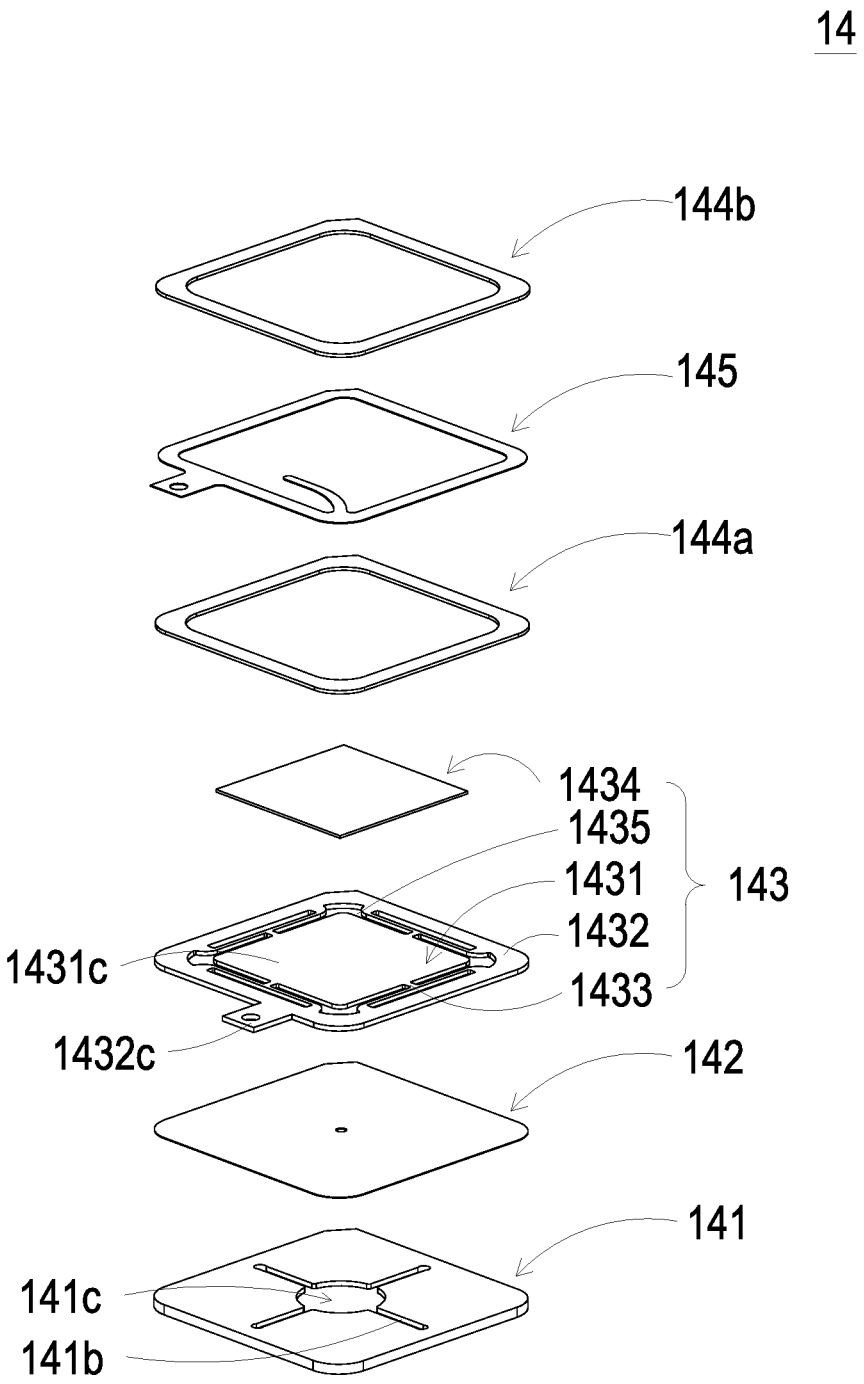
FIG. 5B is a schematic exploded view illustrating the gas pump according to the embodiment of the present disclosure and taken along a rear side.
Figure 6:
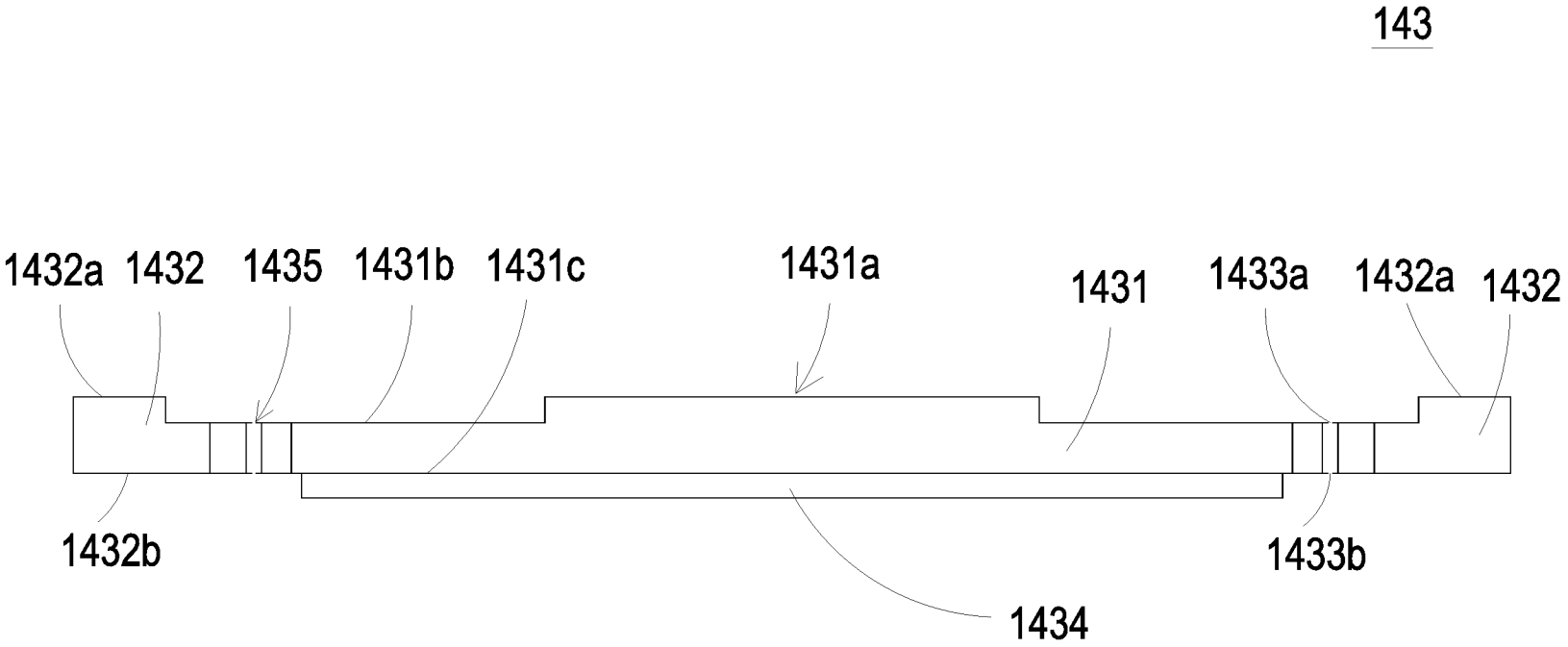
FIG. 6 is a schematic cross-sectional view illustrating the piezoelectric actuator of the gas pump as shown in FIG. 5A.

Please refer to FIGS. 5A, 5B and 6. The gas pumps 14 have the same structures and are enabled to perform same actions. For avoiding redundant description, only the structure of one of the gas pumps 14 is described in the following descriptions. As shown in FIGS. 5A and 5B, the gas pump 14 includes a gas inlet plate 141, a resonance plate 142, a piezoelectric actuator 143, a first insulation plate 144*a*, a conducting plate 145 and a second insulation plate 144*b*, which are stacked on each other sequentially.

In this embodiment, the gas inlet plate 141 has plural inlets 141*a*, plural convergence channels 141*b* and a convergence cavity 141*c*. Preferably but not exclusively, the gas inlet plate 141 has four inlets 141*a* and four convergence channels 141*b*. The inlets 141*a* are perforations penetrating the gas inlet plate 141, so that the gas can be introduced through the inlets 141*a* into the gas pump 14 in response to the action of the atmospheric pressure. The convergence channels 141*b* are spatially corresponding to the inlets 141*a* respectively. The convergence cavity 141*c* is disposed at the intersection of the convergence channels 141*b* and is in communication with the convergence channels 141*b*, such that the gas from the inlets 141*a* would be guided along the convergence channels 141*b* and is converged in the convergence cavity 141*c*. Consequently, the gas can be transported by the gas pump 4. In this embodiment, the gas inlet plate 141 is integrally formed from one piece, but not limited thereto.

In this embodiment, the resonance plate 142 is a sheet made of a flexible material and has a central aperture 142*c*. The central aperture 142*c* is spatially corresponding to the convergence cavity 141*c* of the gas inlet plate 141, thereby allowing the gas to flow therethrough. In other embodiment, the resonance plate 142 may be, for example, made of copper, but not limited thereto.

In this embodiment, the piezoelectric actuator 143 includes a suspension plate 1431, an outer frame 1432, plural brackets 1433 and a piezoelectric element 1434. The piezoelectric actuator 143 has four brackets 1433, but not limited thereto. The number of the brackets 1433 may be varied according to the practical requirements. In this embodiment, the suspension plate 1431 includes a bulge 1431*a*, a first surface 1431*c* and a second surface 1431*b*. The bulge 1431*a* is disposed on the second surface 1431*b* and can be for example but not limited to a circular convex structure. In this embodiment, the outer frame 1432 is a frame structure and is arranged around a periphery of the suspension plate 1431. The brackets 1433 are connected between the outer frame 1432 and the suspension plate 1431 for elastically supporting the suspension plate 1431. Plural vacant spaces 1435 are defined among the brackets 1433, the outer frame 1432 and the suspension plate 1431 and are used to allow the gas to flow through. In this embodiment, the type and the number of the suspension plate 1431, the outer frame 1432 and the brackets 1433 are not limited and may be varied according to the practical requirements. In this embodiment, the outer frame 1432 includes a first conducting pin 1432*c* protruding outwardly therefrom and used to connect an external circuit (not shown) with the gas pump 14 so as to provide driving power, but not limited thereto. In this embodiment, the piezoelectric element 1434 is attached on the first surface 1431*c* of the suspension plate 1431. In response to an applied voltage, the piezoelectric element 1434 drives the suspension plate 1431 to bend and vibrate in vertical direction V (shown in FIGS. 8A to 8E), thereby transporting the gas. The actions of the gas pump 14 are described in the following paragraphs.

As shown in FIG. 6, a top surface of the bulge 1431*a* of the suspension plate 1431 is coplanar with a second surface 1432*a* of the outer frame 1432, while the second surface 1431*b* of the suspension plate 1431 is coplanar with a second surface 1433*a* of the bracket 1433. Moreover, there is a specific depth from the bulge 1431*a* of the suspension plate 1431 (or the second surface 1432*a* of the outer frame 1432) to the second surface 1431*b* of the suspension plate 1431 (or the second surface 1433*a* of the bracket 1433). A first surface 1431*c* of the suspension plate 1431, a first surface 1432*b* of the outer frame 1432 and a first surface 1433*b* of the bracket 1433 are coplanar with each other. The piezoelectric element 1434 is attached on the first surface 1431*c* of the suspension plate 1431. In some other embodiments, the suspension plate 1431 may be a square plate structure with two flat surfaces, but the type of the suspension plate 1431 may be varied according to the practical requirements. In this embodiment, the suspension plate 1431, the brackets 1433 and the outer frame 1432 may be integrally formed from a metal plate (e.g., a stainless steel plate). In an embodiment, the length of a side of the piezoelectric element 1434 is smaller than the length of a side of the suspension plate 1431. In another embodiment, the length of a side of the piezoelectric element 1434 is equal to the length of a side of the suspension plate 1431. Similarly, the piezoelectric element 1434 is a square plate structure corresponding to the suspension plate 1431 in terms of design.

In this embodiment, the gas pump 14 includes the first insulation plate 144*a*, the conducting plate 145 and the second insulation plate 144*b*, which are stacked on each other sequentially and located under the first surface 1432*b* of the outer frame 1432 of the piezoelectric actuator 143. The profiles of the first insulation plate 144*a*, the conducting plate 145 and the second insulation plate 144*b* substantially match the profile of the outer frame 1432 of the piezoelectric actuator 143. In some embodiments, the first insulation plate 144*a* and the second insulation plate 144*b* may be made of an insulating material, for example but not limited to a plastic material, so as to provide insulating efficacy. In other embodiments, the conducting plate 145 may be made of an electrically conductive material, for example but not limited to a metallic material, so as to provide electrically conducting efficacy. In this embodiment, the conducting plate 145 may have a second conducting pin 145*a* disposed thereon so as to be electrically connected with the external circuit (not shown).

Figure 7:
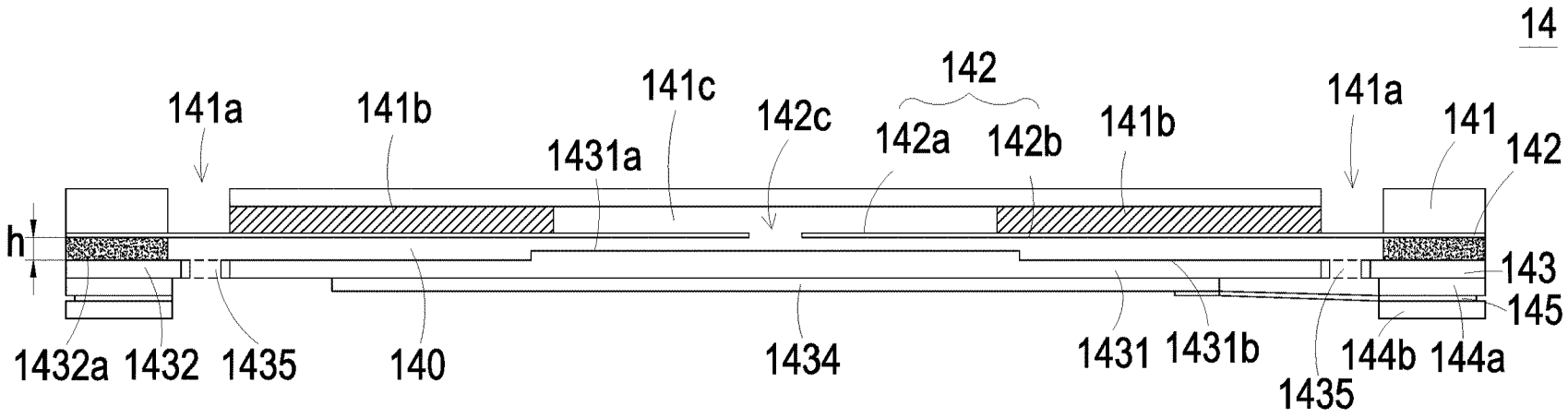
FIG. 7 is a schematic cross-sectional view illustrating the gas pump according to the embodiment of the present disclosure.

Please refer to FIG. 7. In an embodiment, the gas inlet plate 141, the resonance plate 142, the piezoelectric actuator 143, the first insulation plate 144*a*, the conducting plate 145 and the second insulation plate 144*b* of the gas pump 14 are stacked on each other sequentially. Moreover, there is a gap h between the resonance plate 142 and the outer frame 1432 of the piezoelectric actuator 143. In this embodiment, the gap h between the resonance plate 142 and the outer frame 1432 of the piezoelectric actuator 143 may be filled with a filler, for example but not limited to a conductive adhesive, so that a depth from the resonance plate 142 to the bulge 1431*a* of the suspension plate 1431 of the piezoelectric actuator 143 can be maintained. The gap h ensures the proper distance between the resonance plate 142 and the bulge 1431*a* of the suspension plate 1431 of the piezoelectric actuator 143, so that the gas can be transported rapidly, the contact interference is reduced and the generated noise is largely reduced. In some embodiments, alternatively, the height of the outer frame 1432 of the piezoelectric actuator 143 is increased, so that a gap is formed between the resonance plate 142 and the piezoelectric actuator 143, but the present disclosure is not limited thereto.

After the gas inlet plate 141, the resonance plate 142 and the piezoelectric actuator 143 are combined together, a movable part 142*a* and a fixed part 142*b* of the resonance plate 142 are defined. The movable part 142*a* is around the central aperture 142*c*. A chamber for converging the gas is defined by the movable part 142*a* of the resonance plate 142 and the gas inlet plate 141 collaboratively. Moreover, a compressing chamber 140 is defined by the gap h between the resonance plate 142 and the piezoelectric actuator 143 for temporarily storing the gas. Through the central aperture 142*c* of the resonance plate 142, the compressing chamber 140 is in communication with the chamber formed within the convergence cavity 141*c* of the gas inlet plate 141.

Figure 1B:
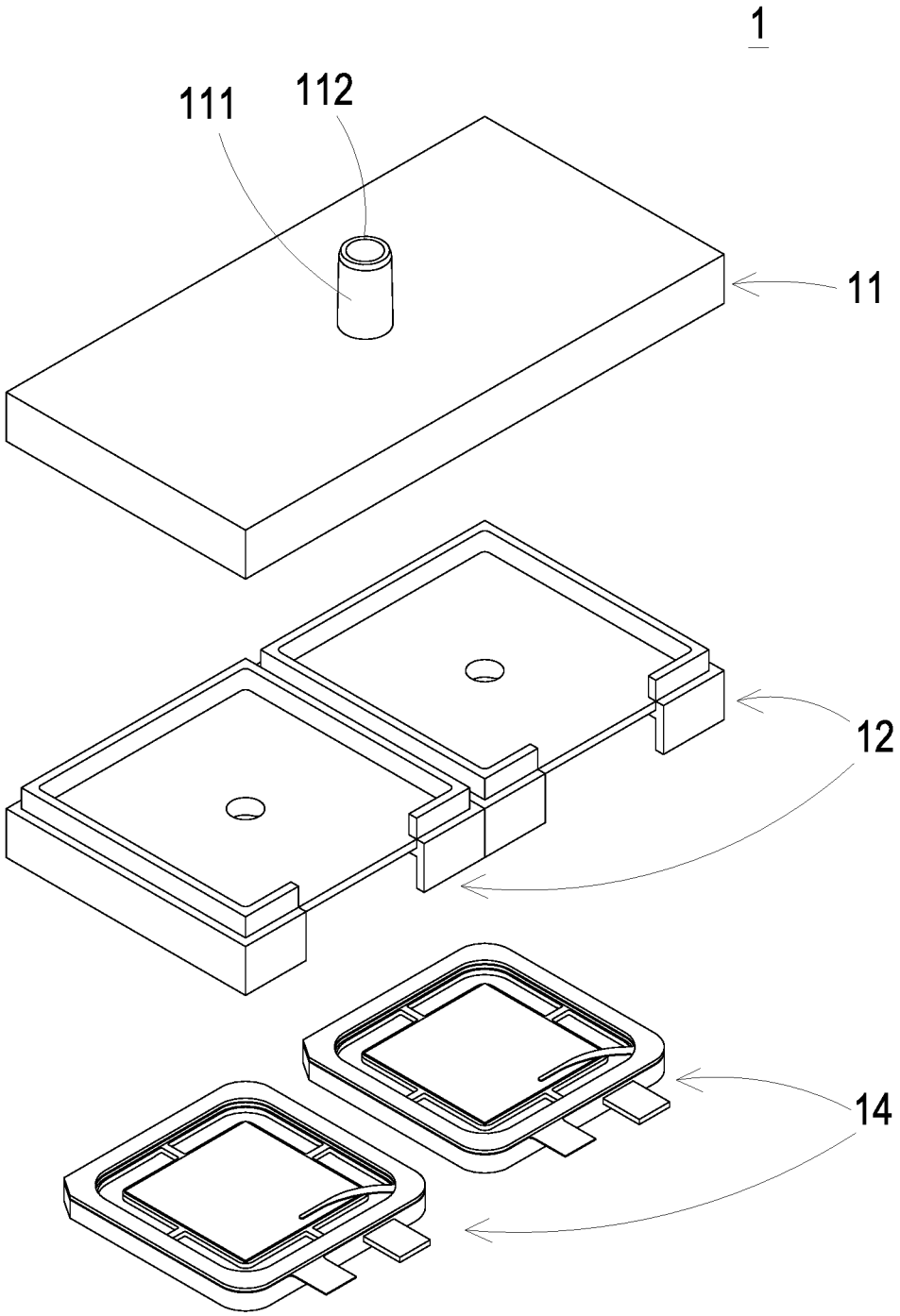
FIG. 1B is a schematic exploded view illustrating the gas transportation device according to the embodiment of the present disclosure.
Figure 4:
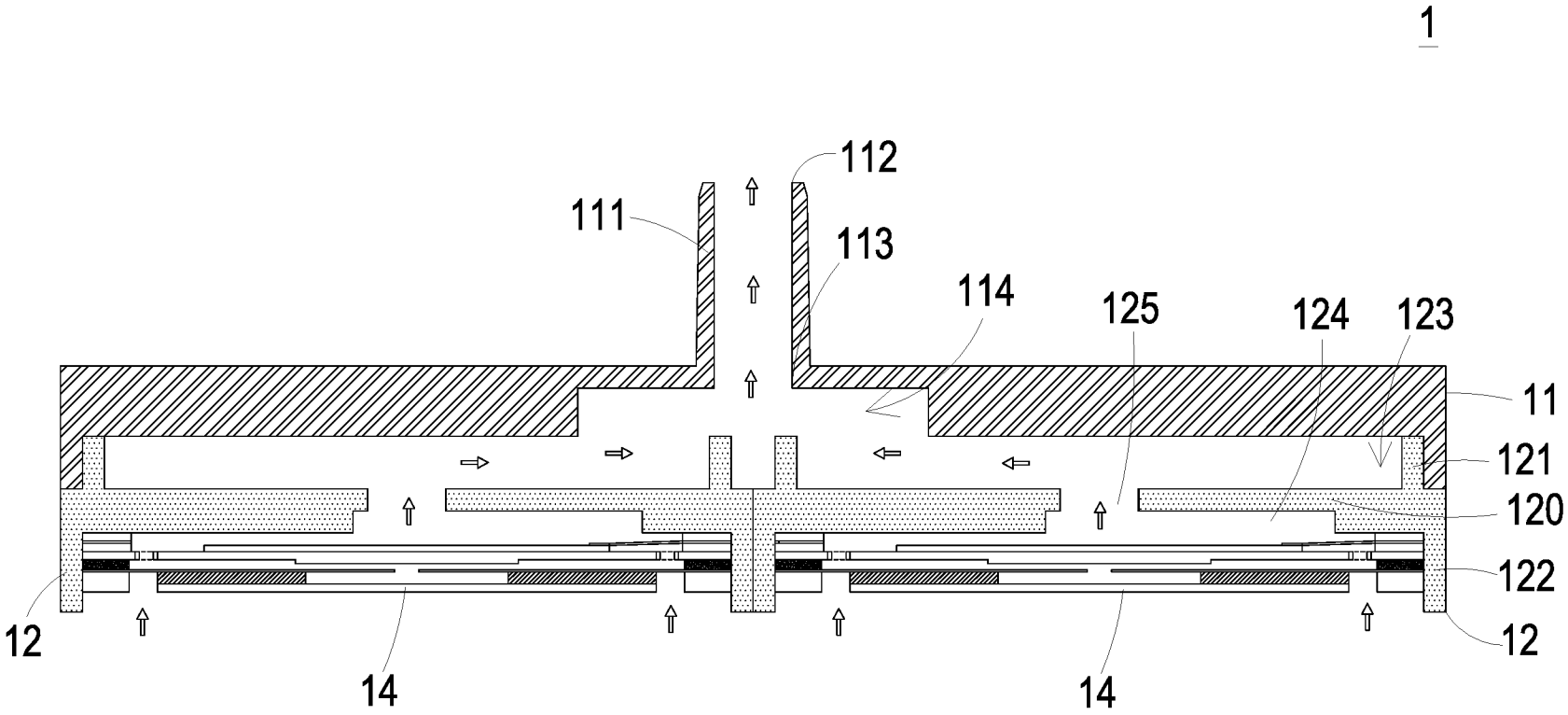
FIG. 4 is a schematic cross-sectional view illustrating the gas transportation device of FIG. 1A and taken along the line A-A.

Please refer to FIGS. 1A, 1B and 4. The gas pumps 14 are disposed in the corresponding chamber frames 122 of the flow-guiding pedestals 12, respectively. The first conducting pin 1432*c* and the second conducting pin 145*a* of the gas pumps 14 protrude out from the pin openings 126 of the chamber frames 122 of the flow-guiding pedestals 12, by which the external circuit (not shown) can be connected to the gas pumps 14 and can provide driving power. The flow-guiding pedestals 12 are arranged side by side in horizontal direction. The gas outlet cover 11 is assembled with the flow-guiding pedestals 12 by engaging with the stepped structures around the protruding frames 121, by which the gas outlet cover 11 is closely connected to the protruding frames 121 of the flow-guiding pedestals 12. Besides, an adhesive may be injected through the adhesive-injecting openings 127 of the protruding frames 121 so as to achieve the sealing and airtight efficacy. Consequently, plural convergence chambers 123 are formed between the gas outlet cover 11 and the protruding frames 121 of the flow-guiding pedestals 12 and are in communication with the gas outlet cavity 114. As described above, owing to the particular design of the protruding frames 121, the flow-guiding pedestals 12 and the gas outlet cover 11 are closely connected to each other. Consequently, the elements of the gas transportation device 1 can be assembled and disassembled easily that the time spent on assembling the components can be largely reduced, and the efficacy of easily replacing the elements can be achieved, so that the flexibility of utilizing the gas transportation device 1 is increased.

While the gas pumps 14 are enabled to transport the gas, the gas is transported through the recesses 124, the communicating apertures 125 and the convergence chambers 123 of the flow-guiding pedestals 12 and the gas outlet cavity 114 substantially, and finally is discharged out from the discharging opening 112 of the gas outlet nozzle 111. In other words, the gas is fed into the gas transportation device 1 by the gas pumps 14 and is further converged along the interior flow path of the flow-guiding pedestals 12 as described above.

Therefore, the efficacy of increasing the gas transporting efficiency is achieved. Moreover, in this embodiment, two gas pumps 14 are employed and disposed side by side. The two gas pumps 14 are enabled simultaneously and transport the gas cooperatively, so that the gas transporting capacity of the gas transportation device 1 is more than single gas pump. Certainly, the number of the gas pumps 14 is not limited to two and may be varied according to the practice requirements.

Figure 8A:
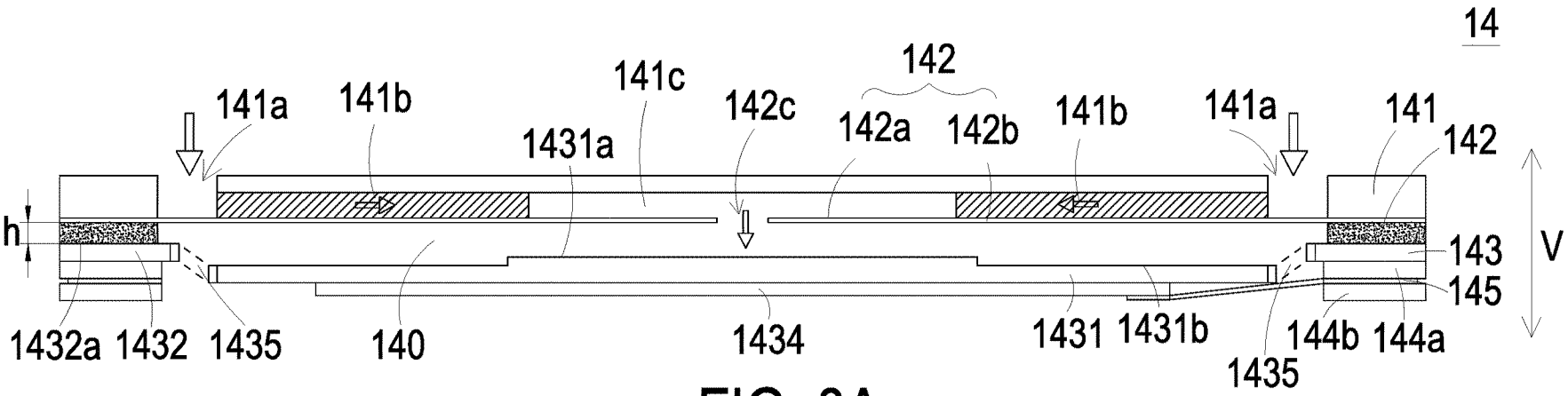
FIGS. 8A to 8E schematically illustrate the actions of the gas pump according to the embodiment of the present disclosure.
Figure 8B:
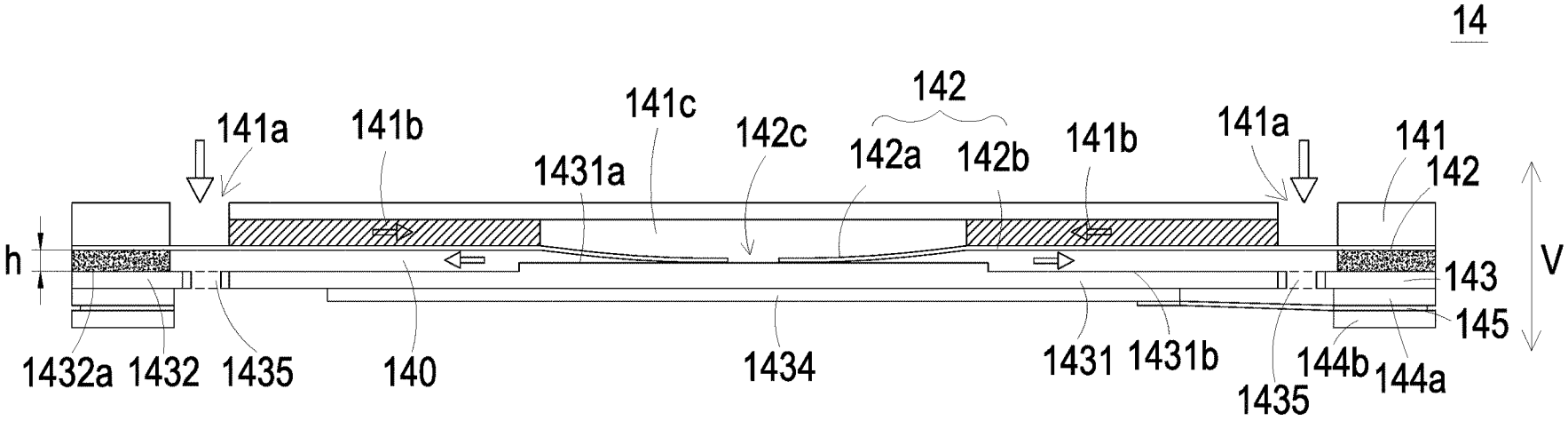
Figure 8C:
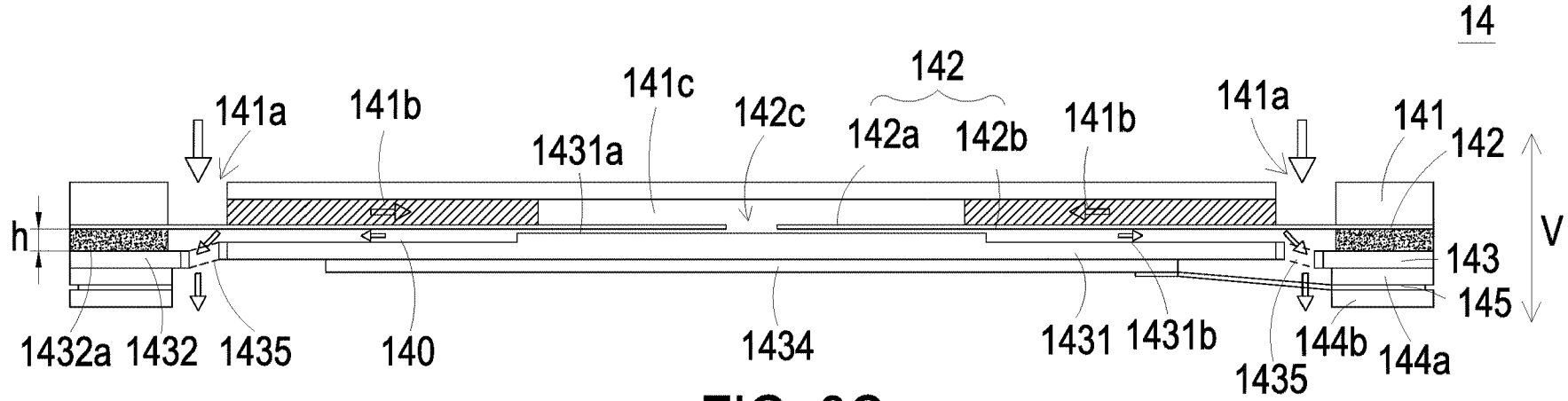
Figure 8D:
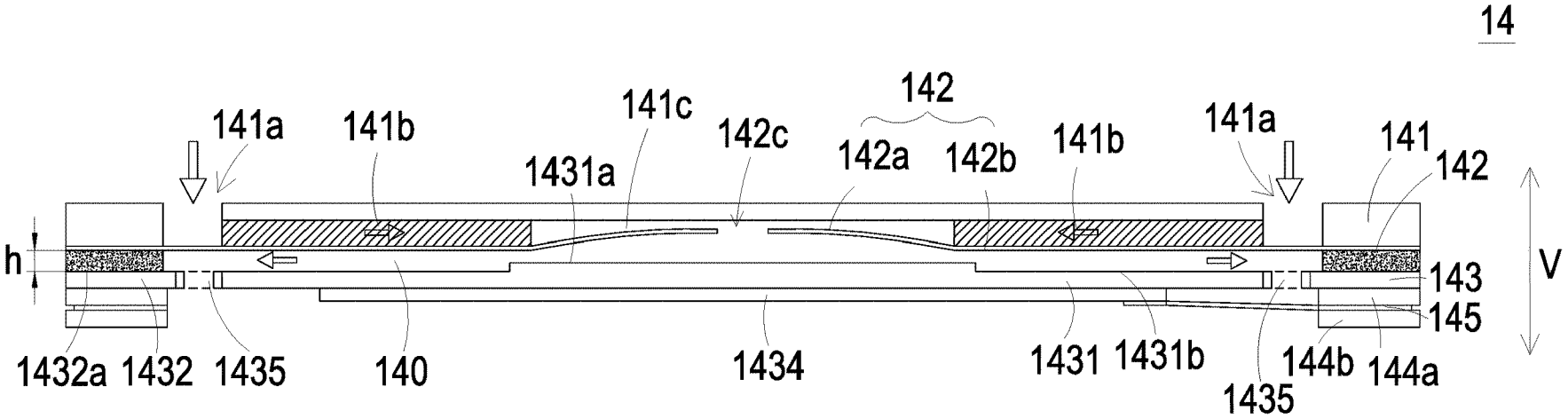
Figure 8E:
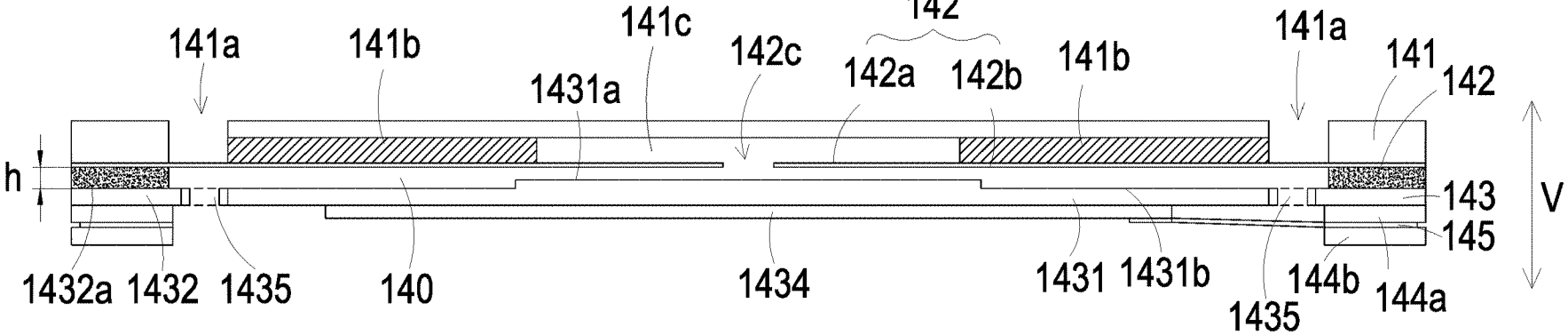

Please refer to FIGS. 8A to 8E. When the gas pump 14 is enabled, in response to an applied voltage, the piezoelectric actuator 143 vibrates along the vertical direction V in the reciprocating manner by using the bracket 1433 as the fulcrum. Firstly, as shown in FIG. 8A, when the piezoelectric actuator 143 vibrates along a first direction of the vertical direction V in response to the applied voltage, the volume of the compressing chamber 140 is enlarged, and the pressure in the compressing chamber 140 is decreased. As a result, the gas is introduced into the gas pump 14 through the inlets 141*a* in response to the action of the atmospheric pressure and is transported to the compressing chamber 140 through the convergence channels 141*b*, the convergence cavity 141 and the central aperture 142*c* sequentially. Then, as shown in FIG. 8B, since the resonance plate 142 is light and thin, when the gas is transported to the compressing chamber 140 in response to the action of the atmospheric pressure, the movable part 142*a* of the resonance plate 142 moves along the first direction to contact and attach on the bulge 1431*a* of the suspension plate 1431 of the piezoelectric actuator 143, and a distance from the fixed part 142*b* of the resonance plate 142 to a region of the suspension plate 1431 except the bulge 1431*a* remains the same. Owing to the deformation of the resonance plate 142 described above, a middle communication space of the compressing chamber 140 is closed, and the volume of the compressing chamber 140 is compressed. Under this circumstance, the pressure gradient occurs to push the gas in the compressing chamber 140 to move toward the peripheral regions of the compressing chamber 140 and to flow through the vacant spaces 1435 of the piezoelectric actuator 143 along the first direction. Referring to FIG. 8C, the movable part 142*a* of the resonance plate 142 returns to its original position when the piezoelectric actuator 143 deforms along a second direction of the vertical direction V during vibration. Consequently, the volume of the compressing chamber 140 is continuously compressed to generate the pressure gradient which makes the gas in the compressing chamber 140 continuously pushed toward the peripheral regions. Meanwhile, the gas is continuously fed into the inlets 141*a* of the gas inlet plate 141, and is transported to the chamber formed within the convergence cavity 141*c*. Then, as shown in FIG. 8D, the resonance plate 142 moves along the second direction, which is in resonance with the vibration of the piezoelectric actuator 143 along the second direction. That is, the movable part 142*a* of the resonance plate 142 also vibrates along the second direction. Consequently, it decreases the flow of the gas transported from the inlets 141*a* of the gas inlet plate 141 into the chamber formed within the convergence cavity 141*c*. At last, as shown in FIG. 8E, the movable part 142*a* of the resonance plate 142 returns to its original position. As the embodiments described above, when the resonance plate 142 vibrates along the vertical direction V in the reciprocating manner, the gap h between the resonance plate 142 and the piezoelectric actuator 143 is helpful to increase the maximum displacement along the vertical V direction during the vibration. In other words, the configuration of the gap h between the resonance plate 142 and the piezoelectric actuator 143 can increase the amplitude of vibration of the resonance plate 142.

From the above descriptions, the present disclosure provides the gas transportation device. The gas pumps are disposed in the flow-guiding pedestals respectively. The flow-guiding pedestals are arranged side by side in horizontal direction and are closely connected to the gas outlet cover. Consequently, the gas transporting efficiency is enhanced, and the gas transporting capacity is increased. Moreover, owing to the particular design of the flow paths and the structures, the gas can be rapidly transported with high efficiency. Furthermore, the silent and miniature efficacy is also achieved.

While the disclosure has been described in terms of what is presently considered to be the most practical and preferred embodiments, it is to be understood that the disclosure needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A gas transportation device, comprising:

a gas outlet cover comprising a gas outlet nozzle and a gas outlet cavity, wherein the gas outlet nozzle and the gas outlet cavity are in communication with and spatially corresponding to each other;

plural flow-guiding pedestals, each of which has a main plate, a protruding frame and a chamber frame, wherein the main plate has a recess and a communicating aperture in communication with the recess; and plural gas pumps disposed inside the chamber frames of the plural flow-guiding pedestals, respectively, wherein the plural flow-guiding pedestals are arranged side by side, the gas outlet cover covers and seals the flow-guiding pedestals and is closely connected to the protruding frames of the plural flow-guiding pedestals, whereby plural convergence chambers are defined and are in communication with the gas outlet cavity, and while the gas pumps are enabled to transport gas, the gas is transported through the recesses, the communicating apertures, the convergence chambers and the gas outlet cavity sequentially, and finally is discharged out from the gas outlet nozzle.

2. The gas transportation device according to claim 1, wherein the gas outlet nozzle is in a conical shape having a larger end and a smaller end that the gas outlet nozzle is gradually tapered from the larger end to the smaller end and has interior diameters gradually decreased from the larger end to the smaller end.

3. The gas transportation device according to claim 1, wherein the protruding frame protrudes above and is arranged around a periphery of the main plate, the chamber frame protrudes below and is arranged around the periphery of the main plate, a side length of the protruding frame is smaller than a side length of the chamber frame, and a stepped structure is formed so that the gas outlet cover is engaged with the stepped structure and disposed on the flow-guiding pedestal.

4. The gas transportation device according to claim 1, wherein the protruding frame has an adhesive-injecting opening, and the chamber frame has a pin opening.

5. The gas transportation device according to claim 1, wherein each of the plural gas pumps comprises:

a gas inlet plate having at least one inlet, at least one convergence channel and a convergence cavity;

a resonance plate having a central aperture;

a piezoelectric actuator comprising a piezoelectric element, a suspension plate, an outer frame, at least one bracket and a first conducting pin, wherein at least one vacant space is defined among the suspension plate, the outer frame and the at least one bracket, the suspension plate has a first surface and a second surface, a bulge is disposed on the second surface, and the piezoelectric element is attached on the first surface;

a first insulation plate;

a conducting plate comprising a second conducting pin; and a second insulation plate, wherein the gas inlet plate, the resonance plate, the piezoelectric actuator, the first insulation plate, the conducting plate and the second insulation plate are stacked sequentially, and a compressing chamber is defined by a gap between the resonance plate and the piezoelectric actuator, wherein in response to an applied voltage, the piezoelectric element drives the suspension plate to bend and vibrate in a vertical direction in a reciprocating manner, whereby the gas is fed through the at least one inlet and is transported to the compressing chamber through the convergence channel, the convergence cavity and the central aperture sequentially, and finally is directed to the recess through the at least one vacant space.

6. A gas transportation device, comprising:

at least one gas outlet cover comprising at least one gas outlet nozzle and at least one gas outlet cavity, wherein the gas outlet nozzle and the gas outlet cavity are in communication with and spatially corresponding to each other;

plural flow-guiding pedestals, each of which has at least one main plate, at least one protruding frame and at least one chamber frame, wherein the main plate has at least one recess and at least one communicating aperture in communication with the recess; and plural gas pumps disposed inside the chamber frames of the plural flow-guiding pedestals, respectively, wherein the plural flow-guiding pedestals are arranged side by side, the gas outlet cover covers and seals the flow-guiding pedestals and is closely connected to the protruding frames of the plural flow-guiding pedestals, whereby at least one convergence chamber is defined and is in communication with the gas outlet cavity, and while the gas pumps are enabled to transport gas, the gas is transported through the recesses, the communicating apertures, the convergence chamber and the gas outlet cavity sequentially, and finally is discharged out from the gas outlet nozzle.

* * * * *